US005257676A

United States Patent [19]

Merkley et al.

[11] Patent Number: 5,257,676

[45] Date of Patent: Nov. 2, 1993

[54] METHOD AND APPARATUS FOR STABILIZING LEVITATED OBJECTS

[75] Inventors: Dennis R. Merkley, Arlington Heights; Charles A. Rey, Riverwoods; Thomas J. Danley, Highland Park, all of Ill.

[73] Assignee: Intersonics Incorporated, Northbrook, Ill.

[21] Appl. No.: 643,846

[22] Filed: Jan. 16, 1991

Related U.S. Application Data

[63] Continuation-in-part of Ser. No. 843,022, Mar. 24, 1986, Pat. No. 5,036,944.

[51] Int. Cl.[5] ..... G10K 11/00

[52] U.S. Cl. ..... 181/0.5; 367/191

[58] Field of Search ..... 73/505; 367/191; 181/0.5

[56] References Cited

U.S. PATENT DOCUMENTS 5,036,947 8/1991 Danley ..... 181/0.5

5,096,017 3/1992 Rey et al. ..... 181/0.5

*Primary Examiner*—J. Woodrow Eldred

*Attorney, Agent, or Firm*—Juettner, Pyle & Lloyd

[57] ABSTRACT

The present invention is drawn to a method of stabilizing the motion of a levitated object. The method involves continuously determining the motion of a levitated object, relative to a given point, and deriving the velocity of the object from the determined motion. A continuous, non-contact, corrective force is applied to the object in the opposite direction and proportional to the derived velocity.

22 Claims, 5 Drawing Sheets

METHOD AND APPARATUS FOR STABILIZING LEVITATED OBJECTS

CROSS REFERENCE

This is a continuation-in-part of application Ser. No. 843,022, filed Mar. 24, 1986 now U.S. Pat. No. 5,036,944.

BACKGROUND OF THE INVENTION

This invention generally relates to levitation of objects wherein remotely generated forces such as acoustic, electromagnetic, or gas flow, are imposed on an object to levitate or position an object in a non-contact fashion.

The above-identified application describes a method and apparatus for acoustic levitation in which an object is suspended between one or more pairs of opposed sound sources. The sound sources are driven at the same frequency and interfere to provide a number of energy wells in which a solid or liquid object may be stably levitated. The phase of one sound source may be adjusted relative to the phase of the other source to move the position of the energy wells and cause the object to move.

Various other types of acoustic and other non-contact levitation techniques are well known. Another acoustic levitator using sound interference is described in U.S. Pat. No. 4,284,403, wherein a sound source is directed toward a small reflector. Acoustic levitators using tuned cavities are described in various patents, including U.S. Pat. Nos. 3,882,732 and 4,052,181. Other types include gas jet and electromagnetic levitators.

A major potential use for levitators is to position materials for processing in the microgravity of outer space. The materials may be suspended in a gas out of contact with the walls of a container. Various space experiments have been conducted in which materials are melted in a furnace and cooled.

One long standing problem in the art of levitation is unwanted motion of a levitated object due to external influences. The specimen or sample to be levitated upon introduction to the acoustic positioning field, may cause unwanted oscillations or motions. Also, especially in the case of acoustic levitation, thermal gradients in the system contribute to specimen instability. A type of motion frequently encountered is an oscillation or rapid back and forth movement along or at an angle to one or more axes of levitation. In acoustic levitation, for example, even intense sound waves produce relatively weak levitation forces, and it is difficult to provide an energy well with sharp, rigid, or impenetrable boundaries. As a result, the levitated object is capable of limited movement between the boundaries of the energy well. These boundaries are resilient, virtually allowing undamped back and forth motion and possible ejection and loss of the specimen.

SUMMARY OF THE INVENTION

An important objective of the present invention is to provide a method and apparatus for levitating an object in a stable and quiescent manner.

Another object of the present invention is to provide a method and apparatus for damping unwanted motions of levitated objects and defining the position of the object with a high degree of precision.

The foregoing objects are accomplished in accordance with the present invention by providing a means or device to continuously sense the position of the levitated object. The sensing means provides a signal from which the velocity of the object at any instant may be determined. This velocity information is fed back via a closed loop in a manner to provide an increased restoring force in opposition to the motion. This additional force is analogous to the viscous drag force on an object as it moves through a gaseous or liquid medium, where the drag force is proportional to the velocity of the object relative to the medium.

For specimens which move or drift slowly, the position information used directly as negative feedback to make the correction, or move the object back to the desired or original position. This position control is independent of velocity damping control and provides precise control of specimen position. The combination of the two corrections provides optimal control of both motion and displacement. The signal from the position sensor may also be integrated to provide an additional form of control.

The acoustic levitation device described in the above-referenced patent application is particularly suitable to the motion damping and position control of the present invention. The motion control feedback system is employed to provide the appropriate phase shifts to the sound sources to create the necessary correction forces.

THE DRAWINGS

DESCRIPTION OF THE PREFERRED EMBODIMENTS

Figure 1:
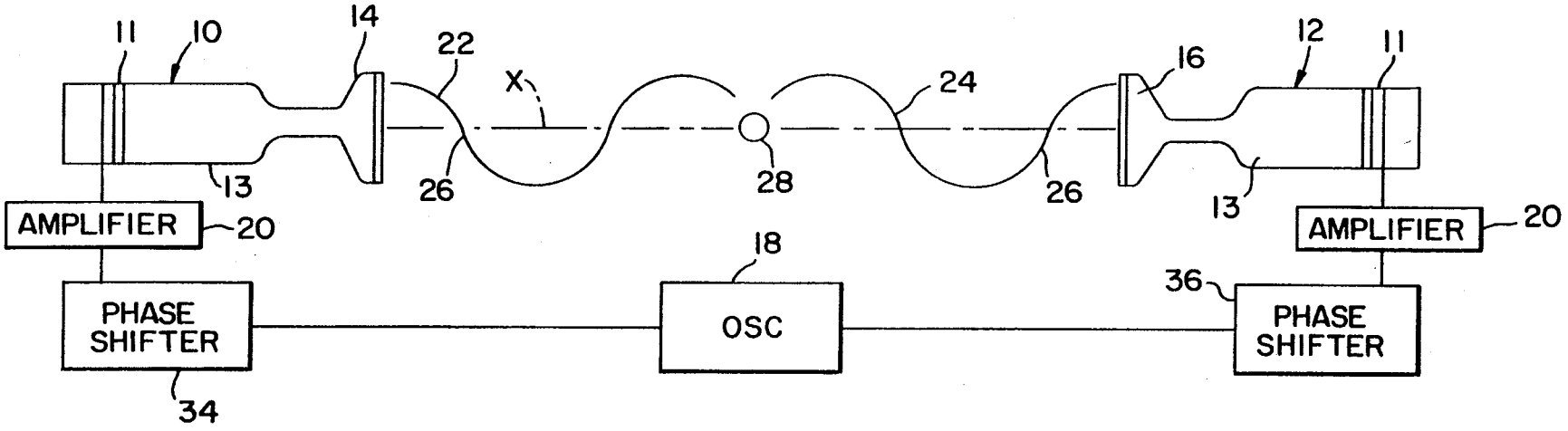
FIG. 1 is a schematic view of the preferred acoustic levitator used in connection with the present invention.

FIG. 1 illustrates a pair of opposed sound sources 10 and 12 having respective sound radiating surfaces 14 and 16 which generate sound toward each other substantially along a common axis x. The sound sources may be conventional in nature but preferably are capable of producing directional or focused sound of high intensity, i.e., above 120 dB. The sound sources or transducers 10 and 12 may be of the solid piston type containing electro-mechanical driving means, such as piezoelectric or magnetostrictive, or a conventional voice coil.

As shown in FIG. 1, the sound radiating surfaces 14 and 16 may be concave or dish shaped in order to concentrate or beam a useful column of intense sound in opposite directions along the axis x. The sound sources are connected to a common oscillator 18 and amplifiers 20 to produce sound at the same frequency. In the embodiment shown, each sound source includes a plurality of piezoelectric wafers 11 receiving a signal from the oscillator 18 and held in compression with a cylindrical rod or piston 13 secured to the radiating surfaces 14 and 16. The wafers expand and contract or vibrate at high levels of force to cause vibration of the rod 13 and radiator 14 or 16.

When the sound sources 10 and 12 are driven at the same frequency, an interference wave pattern is established therebetween. Preferably, the sound sources are also driven at the same intensity to produce a uniform interference pattern. For the sake of illustration, the pattern shown in FIG. 1 is shown to include a sound wave 22 from source 10 and a sound wave of the same wavelength 24 from source 12, which, at certain points along the axis x, interfere and reinforce each other and provide nodes 26 of low acoustic pressure. The nodes 26 appear at each half wavelength of the sound being used and define energy wells in which solid or liquid objects such as 28 may be stably levitated. The nodes or energy wells 26 provide resultant forces which hold or contain the object 28 both axially and radially. If the sound being employed is sufficiently intense objects may be levitated against the force of gravity.

With further reference to FIG. 1, phase shift controls 34 and 36 are connected to either one or both of the sound sources in order to change the phase of one sound source relative to the other. The shifters 34 and 36 may be adjusted to provide a positive, negative or zero change of phase of one sound source relative to another. A change of relative phase between the sound sources causes a corresponding change in the location of the energy wells 26 along the axis x. Thus, a change in phase will cause the levitated object 28 to move along the axis x in either axial direction, depending on whether a positive or negative phase change is made.

The degree of axial movement ($\Delta X$) or translation of the levitated object for a given change of phase in radians ($\Delta\Phi$) at a given wavelength ($\lambda$) is defined as:

$$\Delta x = \frac{\Delta\Phi}{2\pi} \cdot \frac{\lambda}{2}$$

The velocity of the levitated object during a continuous and constant rate of phase change per unit time is defined as:

$$\frac{\Delta x}{\Delta \tau} = \frac{\lambda}{4\pi} \cdot \frac{\Delta\Phi}{\Delta \tau}$$

It may be seen that a relative change between the two sound sources allows movement of the levitated object toward or away from either sound source at a constant or variable speed. For example, a rapid periodic reversal or modulation of phase would cause the object to be agitated or vibrated. The phase change can be programmed in advance, for example, to move an object to a given location, stop the object, and then move the object away from the location along the common axis. Thus, the levitated object could be moved into a hot zone for melting and then into a cool zone.

Figure 2:
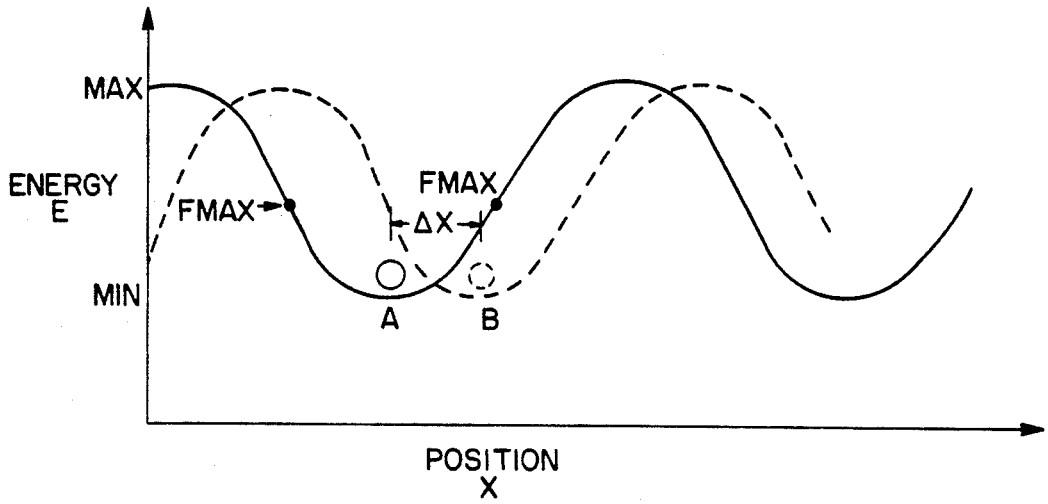
FIGS. 2 and 3 are graphical plots illustrating the energy and force on an object levitated by the apparatus shown in FIG. 1.

FIG. 2 illustrates the energy gradients within an acoustic energy well and the acoustic forces on a levitated object, with energy (E) being plotted against position (X). The natural position of the specimen is shown at A for a quiescent condition and is located at the point of minimum energy. If the position of the energy well is shifted, as shown by the dotted curve, the specimen would encounter an energy gradient, thereby causing the specimen to move to a new position B over a distance $\Delta X$. If no other changes are made, the specimen will oscillate and eventually come to rest in the new minimum energy position.

The maximum force that can be applied to the specimen is achieved where the energy gradient is at maximum, which appears as indicated on the FIG. 2 plot at points or regions of maximum slope in the curve. In order to impose additional force on the specimen, the amplitude force on the specimen, the amplitude of the energy and corresponding curve can be increased, which effectively makes the energy well deeper and increases the slope of the energy gradient curve.

Figure 3:
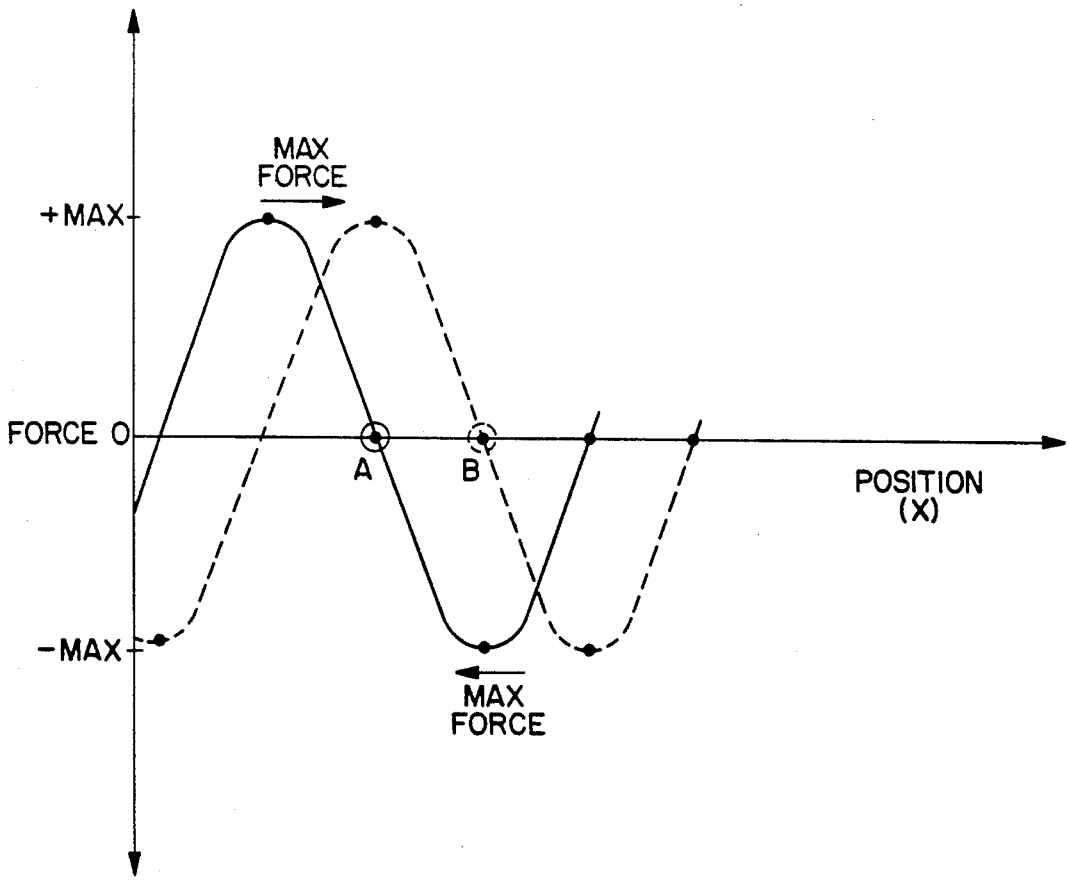

The above principle is further illustrated in FIG. 3, which illustrates the force encountered by an object or specimen in an energy well relative to position. When the object is at rest, there is little or no force acting on the object, and any forces encountered are equal and in opposite direction. It may be seen that any shift in the energy well position or specimen position will result in a directional force on the object. Again, if no other forces are applied, the specimen will eventually stabilize in the energy well.

Figure 4:
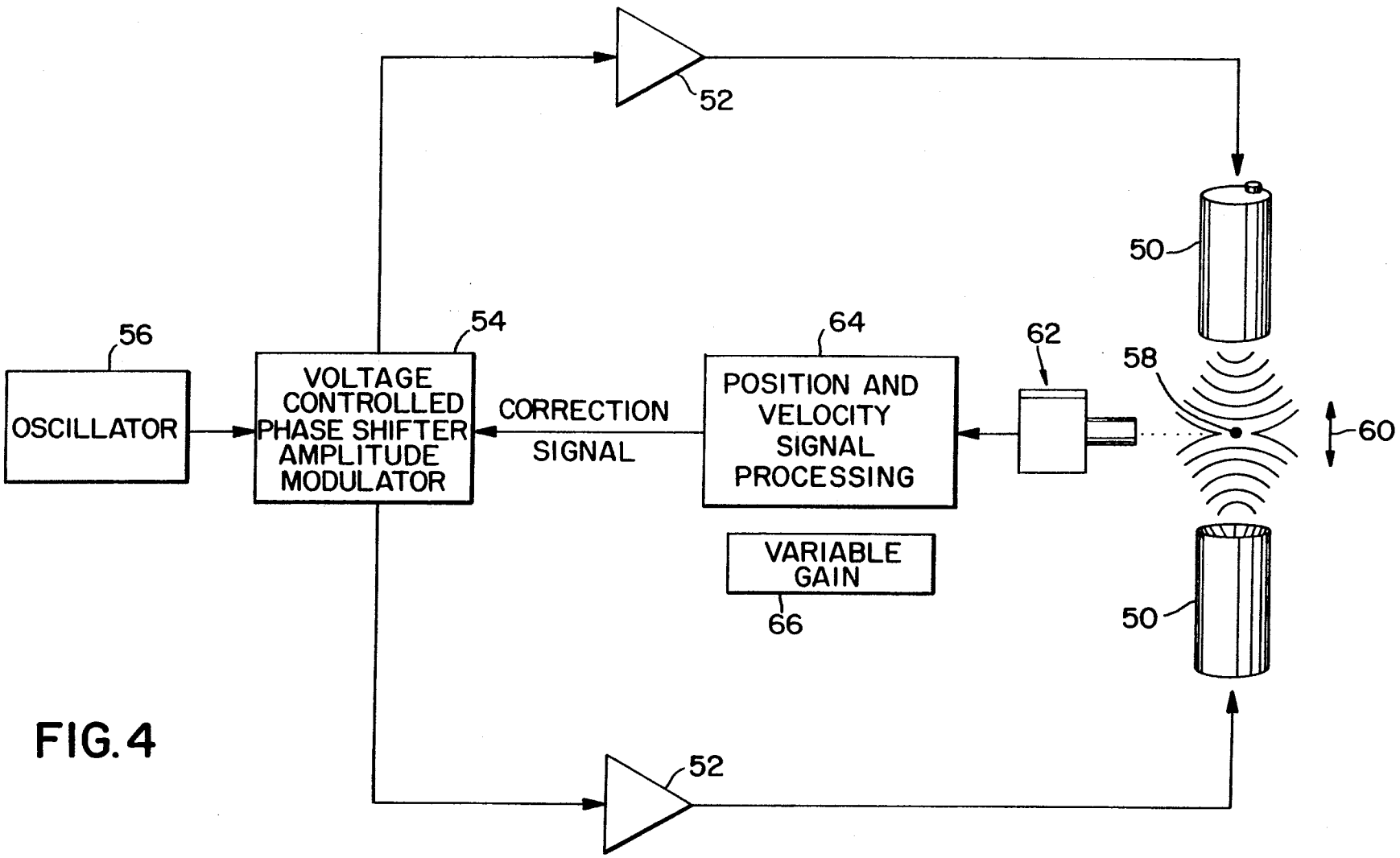
FIG. 4 is a schematic illustration of the apparatus of the present invention, in which the object is levitated by a pair of opposed sound sources along a single axis.

FIG. 4 illustrates the same type of acoustic levitator shown in FIG. 1, with a pair of opposed sound sources 50 driven by respective amplifiers 52 connected to a phase shifting device 54, which is voltage controlled. An oscillator 56 is connected to the phase shifter 54 to provide a signal to produce sound at the desired frequency. Thus sound is produced by the sources to position and levitate an object, shown at 58.

Regenerative motions of the levitated object can and do occur, and these motions, in the type of apparatus described, may occur along the axis between the sound sources, or in the directions indicated by arrow 60.

In order to damp or prevent unwanted motions of the object 58 along axis 60, a system is provided to continuously establish an acoustic force in a direction opposite to the motion or velocity of the object, with the magnitude of the force being in some way proportional to the velocity or position of the object.

The apparatus includes a means for sensing the position of the object, shown generally at 62. Preferably, the position sensing means is of a type which does not contact the object and may be spaced therefrom outside of the acoustic field. In the embodiment shown, the sensing device is a video camera, specifically a CCD linear array video camera or a monolithic linear photo detector. Other types of detectors may be employed, such as magnetic, acoustic or rf. It is also possible to monitor motion of the object by monitoring the electrical impedance of the sound sources.

In the embodiment shown, the specimen 58 is imaged onto the detector 62 by appropriate optics. The detector monitors the area in which the object may move and provides a voltage signal corresponding to the position of the object along the axis. In the embodiment shown, a null signal is produced when the object is at a predetermined position or null point, and a negative or positive signal is produced when the object is in a position on either side of the null point. Thus, each position of the object corresponds to a specific voltage level.

Figure 5:
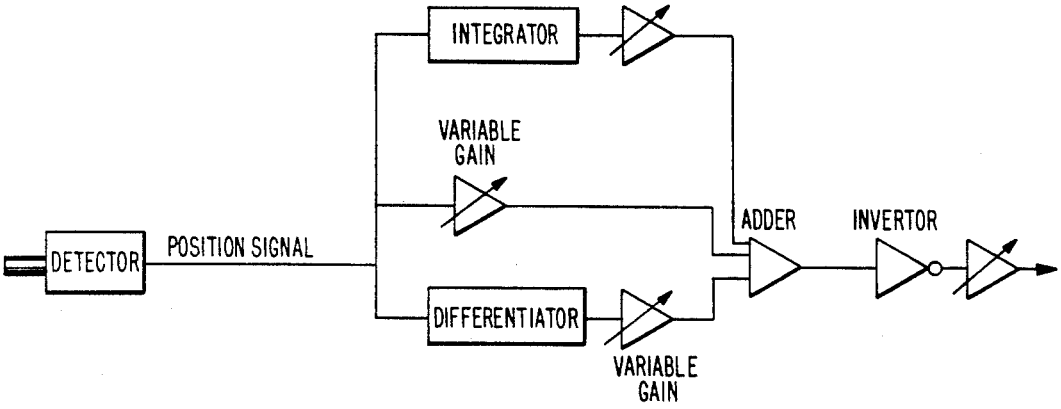
FIG. 5 is a schematic view of the feedback portion of the apparatus shown in FIG. 4.

The sensing means 62 is connected to a signal processor 64, which is also shown schematically in FIG. 5. The voltage from the sensing means 62, which corresponds to object position, may be divided into three branches, each having a variable gain control. In one branch, the voltage is differentiated, producing the first derivative of position, which represents velocity of the object and has a 90° phase lead with respect to the position signal. A second branch of the circuit carries the positional signal. The position and velocity signals are combined by an adder and inverted to provide a correction signal. Inversion is necessary to provide negative feedback of the signals and to impose corrective counterforces to the object.

Also as shown in FIG. 5, a third branch may be connected to the voltage of the position signal, and conventional electronic components may be employed to integrate the signal over a period of time, and the result is added to the other signal components and inverted as aforesaid. The use of the integrated component is beneficial especially if the position feedback gain is insufficient. The integrated signal does not respond to quick impulses as do the position and velocity signals; instead, it senses position shifts which are maintained for longer durations and effectively increases the loop gain with increasing time until sufficient correction occurs to force the specimen back to its null position. For most applications, it will be desirable to have velocity feedback combined with either position or integrated feedback, or both. If only slow drifts of the specimen are encountered, integrated feedback alone may be sufficient.

The signal processor 64 is connected to the phase shifter 54, which is responsive to the correction signal from the processor. This correction signal is comprised of the inverted position, velocity and integrated signals. Upon receipt of a signal, the phase is shifted to an extent to cause movement of the acoustic energy well in which the object is contained. By using the inverted position and velocity signals, the phase is shifted in a direction such that the energy well moves in a direction opposite to the direction of movement or position of the object. In effect, this produces an increased acoustic restraining or drag force in opposition to movement of the object.

Figure 6:
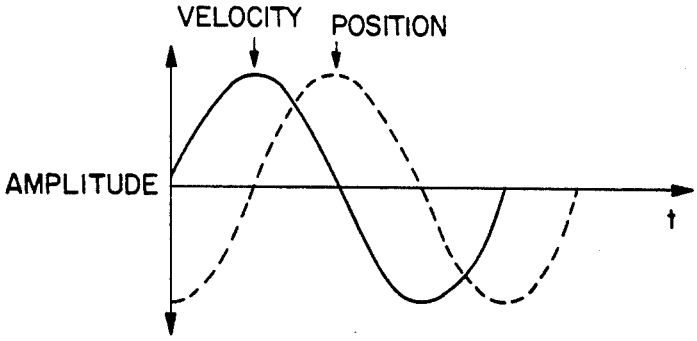
FIG. 6 is a plot of amplitude of the motion of a levitated object in relation to time, illustrating the relation between velocity and position.

To further illustrate the principles involved, reference is made to FIGS. 5 and 6. External influences may cause the levitated object to oscillate back and forth parallel to the arrow 60 along the levitation axis. The motion is similar to a pendulum, with the velocity being zero at the maximum displacement of the specimen, with increasing velocities from each extreme. This is most clearly shown in FIG. 6 showing plots of specimen displacement per unit time in terms of displacement and velocity, with the velocity leading by 90° with respect to position. The signals shown in this figure are the true position and velocity signals and therefore must be inverted to provide negative feedback and correction. When the object moves (at maximum velocity) through the null point or centroid of the energy well, the feedback component or components dynamically shifts the relative phase between the sound sources by an amount corresponding to the derived velocity of the specimen. This shifts the energy well in a direction opposite the object motion so that the steeper parts of the energy well are encountered sooner than if the well position was constant. By providing maximum opposing force when the specimen velocity is at maximum, effective damping is provided. The corrective acoustic force is reversed when the object reaches an extreme and reverses direction.

In addition to the phase shift control 54 to control the position and force on the levitated object, such control may also include a circuit or other means to adjust the amplitude of the sound to supplement the counterforces on the moving object, as shown schematically in FIG. 4. By dynamically modifying the acoustic amplitude, improved motion damping can be achieved, especially with higher density specimens. Also, amplitude modulation allows a lower average sound pressure level to be used.

It may be seen that negative feedback of position information alone would not serve to damp unwanted motions. With position feedback alone, the increase in restoring force is proportional to the amplitude of position displacement from the chosen null position. A specimen displaced from its null position will be forced back with greater force than would occur with no feedback. Thus, the velocity of the specimen as it passes through the null will be correspondingly greater. The momentum may be sufficient to actually cause an increase in displacement. If the feedback gain is sufficiently high, regenerative oscillation may occur and may cause ejection of the object from the energy well.

Also, as shown in FIG. 4, gain controls 66 may be provided in the circuit to control the level of the feedback signal and thereby the degree of phase shift and corrective forces. The gain may be adjusted, for example, to accommodate variables in the system including specimen density and sound pressure level.

In the type of levitation apparatus shown in FIG. 4, motion damping occurs along the axis of levitation, or in a line parallel to arrow 60. With such an arrangement, unwanted movements of the levitated object at angles to the axis cannot be damped, which leaves open the possibility that the specimen will escape laterally. This is due, in part, to the relatively weak restoring forces in the radial direction of the single axis levitator. FIG. 3 illustrates a version in which motion dampening can be obtained in more than one axis.

Figure 7:
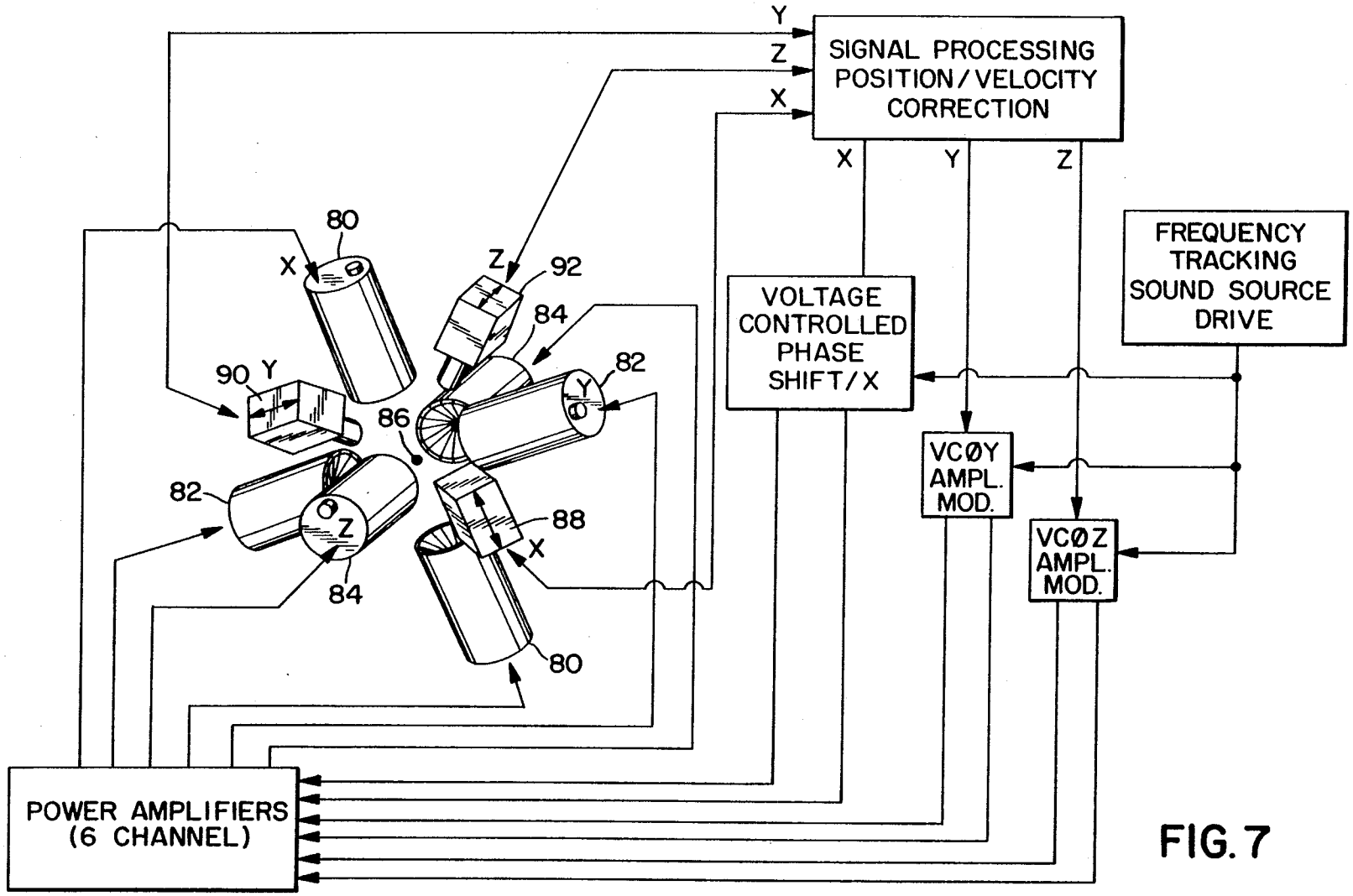
FIG. 7 is a schematic illustration of another embodiment of the present invention, in which the object is being levitated by three pairs of opposed sound sources along three orthogonal axes.

As shown in FIG. 7, three pairs of opposed sound sources 80, 82 and 84 may be disposed with their respective axes of levitation along an X, Y and Z axis, with an object 86 being levitated at the common intersection of the three axes. In the embodiment shown, the three orthogonal axes correspond to cartesian coordinates which intersect at right angles in three dimensions.

The embodiment shown in FIG. 7 is similar than that of FIG. 4, except that separate feedback control is provided along each of the levitation axes. Hence, three separate detectors 88, 90 and 92 are employed to provide independent position feedback to a signal processor which provides correction signals to three independent phase shift devices as described in the previous embodiment. In this manner, motion damping and positioning may take place in three axes simultaneously and independently, resulting in excellent stability in all directions.

We claim:

1. Method of stabilizing motion of a levitated object wherein said object is moving in a direction away from a given point, said method comprising the steps of continuously determining the motion of said object relative to the given point, deriving the velocity from said motion, and continuously applying an external non-contact force to said object in the other direction and proportional to said velocity.

2. The method of claim 1 wherein the external non-contact force is an acoustic force.

3. The method of claim 2 wherein the step of continuously determining the motion of said object comprises measuring the displacement of the object from said given point to provide a voltage signal in proportion to said displacement.

4. The method of claim 3 wherein said voltage signal is differentiated to provide a first signal proportional to velocity, and wherein said first signal is inverted to apply said acoustic force in said other direction.

5. The method of claim 4 wherein said voltage signal is divided to provide a second signal in proportion to displacement and is added to said first signal.

6. The method of claim 3 wherein said voltage signal is integrated an inverted.

7. A method of stabilizing movement of an object away from a null point while being levitated by acoustic forces, said method comprising the steps of continuously sensing the position of the object relative to said null point to provide a first electrical signal corresponding to the object position, deriving the velocity of said object from said first signal to provide a second signal, and using said second signal as a feedback to provide an acoustic force in opposition to said movement, with said acoustic force being proportional to said second signal and said velocity.

8. The method of claim 7 comprising the additional step of using said first signal as a feedback to position said object at a fixed location.

9. A method of stabilizing unwanted movement of an object being levitated by acoustic forces, said method comprising the steps of providing a pair of opposed sound sources operating at the same frequency and intensity sufficient to produce interference and at least one energy well for levitating an object, continuously determining the velocity and direction of the moving object, and adjusting the relative phase between the sound sources to provide a restraining acoustic force on said object in the opposite direction and in proportion to said velocity.

10. The method of claim 9 wherein said step of continuously determining the object and direction of said object comprises the steps of continually sensing the position of the object to provide a first signal proportional to position, and differentiating said first signal to provide a feedback signal proportional to velocity.

11. The method of claim 10 comprising the additional step of using said first signal to control the relative phase between the sound sources to adjust the position of the object.

12. The method of claim 10 comprising the additional step of integrating said first signal to provide a feedback signal.

13. The method of claim 10 comprising the additional step of providing a plurality of opposed sound sources having intersecting radiation axes to provide an energy well for levitating said object, and determining the velocity of the object along each axis to provide separate acoustic restraining forces on said object simultaneously.

14. The method of claim 10 wherein said feedback signal is inverted.

15. Apparatus for stabilizing unwanted movement of a levitated object in an acoustic levitation device, said apparatus comprising levitation means for imposing non-contact levitation forces on said object, sensing means spaced from said object for continuously determining the position of said object, and feedback means between said sensing means and said levitation means, said feedback means comprising processor means responsive to said sensing means for continuously deriving the velocity of said object, and means responsive to said processor means for imposing a non-contact force on said object in opposition to said movement of said object and in proportion to said velocity.

16. The apparatus of claim 15 wherein said sensing means is a video detector.

17. The apparatus of claim 15 wherein said sensing means provides an electrical signal in proportion to the displacement of said object from a given position, and said processor means includes means for differentiating and inverting said signal.

18. The apparatus of claim 15 wherein said sensing means provides a voltage signal in proportion to the position of said object relative to a given point.

19. The apparatus of claim 18 wherein said feedback means and said processor means comprise means for differentiating said voltage signal to provide a first signal in proportion to velocity, means for integrating said voltage signal to provide a second signal, means for adding said signal to provide a combined signal, and means for inverting the combined signal.

20. The apparatus of claim 15 wherein said levitation means comprises a pair of opposed sound sources operating at the same frequency to provide an energy well on an axis between the sound sources.

21. The apparatus of claim 20 comprising means of adjusting the phase between said sound sources responsive to said processor means.

22. The apparatus of claim 20 comprising means for adjusting the amplitude of the sound sources.

* * * * *